United States Patent [19]

Ikeura et al.

[11] 4,387,681

[45] Jun. 14, 1983

[54] FUEL SUPPLY CONTROL SYSTEM FOR AN INTERNAL COMBUSTION ENGINE

[75] Inventors: Kenji Ikeura; Tatsuo Morita, both of Yokosuka, Japan

[73] Assignee: Nissan Motor Company, Limited, Kanagawa, Japan

[21] Appl. No.: 230,289

[22] Filed: Jan. 30, 1981

[30] Foreign Application Priority Data

Jan. 31, 1980 [JP] Japan ..... 55-10499

[51] Int. Cl.[3] ..... F02D 33/00

[52] U.S. Cl. ..... 123/325; 123/340; 123/350

[58] Field of Search ..... 123/325, 339, 340, 349, 123/395, 350, 326, 332

[56] References Cited

U.S. PATENT DOCUMENTS

| | | | |
|---|---|---|---|
| 3,570,460 | 3/1971 | Rabus | 123/325 |
| 3,703,162 | 11/1972 | Aono | 123/325 |
| 4,243,002 | 1/1981 | Freyer et al. | 123/325 |
| 4,253,437 | 3/1981 | Haramoto | 123/325 |
| 4,305,365 | 12/1981 | Itzuka et al. | 123/325 |

FOREIGN PATENT DOCUMENTS

| | | | |
|---|---|---|---|
| 2018587 | 5/1970 | France . | |
| 2066335 | 8/1971 | France . | |
| 2376948 | 8/1978 | France . | |
| 2467294 | 4/1981 | France . | |
| 2038041 | 7/1980 | United Kingdom | 123/339 |
| 2062295 | 5/1981 | United Kingdom . | |

*Primary Examiner*—William A. Cuchlinski, Jr.

*Attorney, Agent, or Firm*—Lowe, King, Price & Becker

[57] ABSTRACT

Fuel consumption of a declerating automotive vehicle internal combustion engine is reduced while preventing stalling. In response to a valve for selectively supplying air and fuel to the engine being in a fully closed condition, a first signal is derived. In response to the engine speed dropping below a first predetermined value a second signal is derived. In response to derivation of the first and second signals a controller for the valve is activated. The controller responds to engine and brake responsive parameters of the vehicle for opening the valve in respone to any of: (a) the engine being decelerated under no load, and (b) the brake being abruptly applied and (c) the engine speed dropping below a second value. The second value is less than the first value and is determined in response to the rate of change of engine speed.

26 Claims, 6 Drawing Figures

FUEL SUPPLY CONTROL SYSTEM FOR AN INTERNAL COMBUSTION ENGINE

BACKGROUND OF THE INVENTION

1. Field of the Invention

The present invention relates to a fuel supply control system for an internal combustion engine.

The present invention relates more particularly to a fuel supply control system wherein the fuel supply is cut off when the engine is decelerated from a first predetermined value and is resumed when the engine is further decelerated to a lower speed through a second predetermined value.

2. Description of the Prior Art

A conventional fuel supply control system installed in an internal combustion engine of an automotive vehicle cuts off the fuel supply during deceleration of the vehicle when fuel is generally not necessary for the engine, thus saving a considerable amount of fuel and maintaining an appropriate air-to-fuel ratio.

In this case, the conventional fuel supply control system does not cut off the fuel supply without reason but cuts off the fuel supply only when the speed of engine rotation, and thus the vehicle speed, drops from above a first predetermined value. Thereafter, the fuel supply is restored when such deceleration ends, or when the vehicle speed drops from the first predetermined value to a second predetermined value. Consequently, fuel supply cutoff can be prevented at a region of low vehicle speed and low engine rotation speed below the second predetermined value which might otherwise cause the engine to stall and hunting can also be prevented by the control of the fuel supply cutoff.

However, such a conventional fuel supply cutoff system has the problem that the fuel supply is resumed in the same way in response to the vehicle decelerating to arrive at the second predetermined value when the engine rotation speed decreases slowly while an accelerator pedal is slowly released to rotate the engine through a driving wheel for engine braking. The fuel supply is also resumed when the engine rotation speed drops abruptly during depression of the accelerator pedal and the transmission is in neutral so the vehicle is under no load. The fuel supply is also resumed when the vehicle is stopped by the sudden application of the brake pedal, so that during a delay between the resumption of fuel being supplied to the engine and the engine responding to the fuel, the engine rotation drops to a very low speed.

Consequently, in order to prevent the engine from stalling after a sudden depression of the brake pedal and a sudden release of the accelerator pedal, a second predetermined value is specified at which the fuel supply is resumed at much higher engine rotation speed than the value at which the engine would stall when the rotation speed is reduced slowly under the engine braking.

However, in such a case described above an unnecessary amount of fuel is consumed so that in the conventional fuel supply cutting off and recovery system there is a need for improving the fuel consumption.

SUMMARY OF THE INVENTION

In respect of the above-described problem, it is an object of the present invention to provide a fuel supply control system which achieves reduction of fuel supplied to an internal combustion engine of an automotive vehicle, by determining whether the automotive vehicle is decelerating with the engine no load or by the sudden application of the brake pedal or under the engine braking, by modifying a predetermined engine speed value which specifies the speed at which the fuel supply is resumed when the engine speed is reduced from another predetermined speed value higher than that within a region where the engine stalling does not occur if the fuel supply control system determines the engine is decelerated under the engine brake is applied slowly. The fuel supply control system according to the present invention is particularly effective in the case of a carburetor fuel supply system where the distance from the fuel supply means to the intake valve is so long that there is a large response delay from the fuel supply recovery to the re-generation of an engine torque.

BRIEF DESCRIPTION OF THE DRAWINGS

The features and advantages of the fuel supply cutoff system according to the present invention will be better appreciated from the following description taken in conjunction with the accompanying drawings in which like reference numerals designate corresponding elements, and in which.

DESCRIPTION OF THE PREFERRED EMBODIMENT

Figure 1:
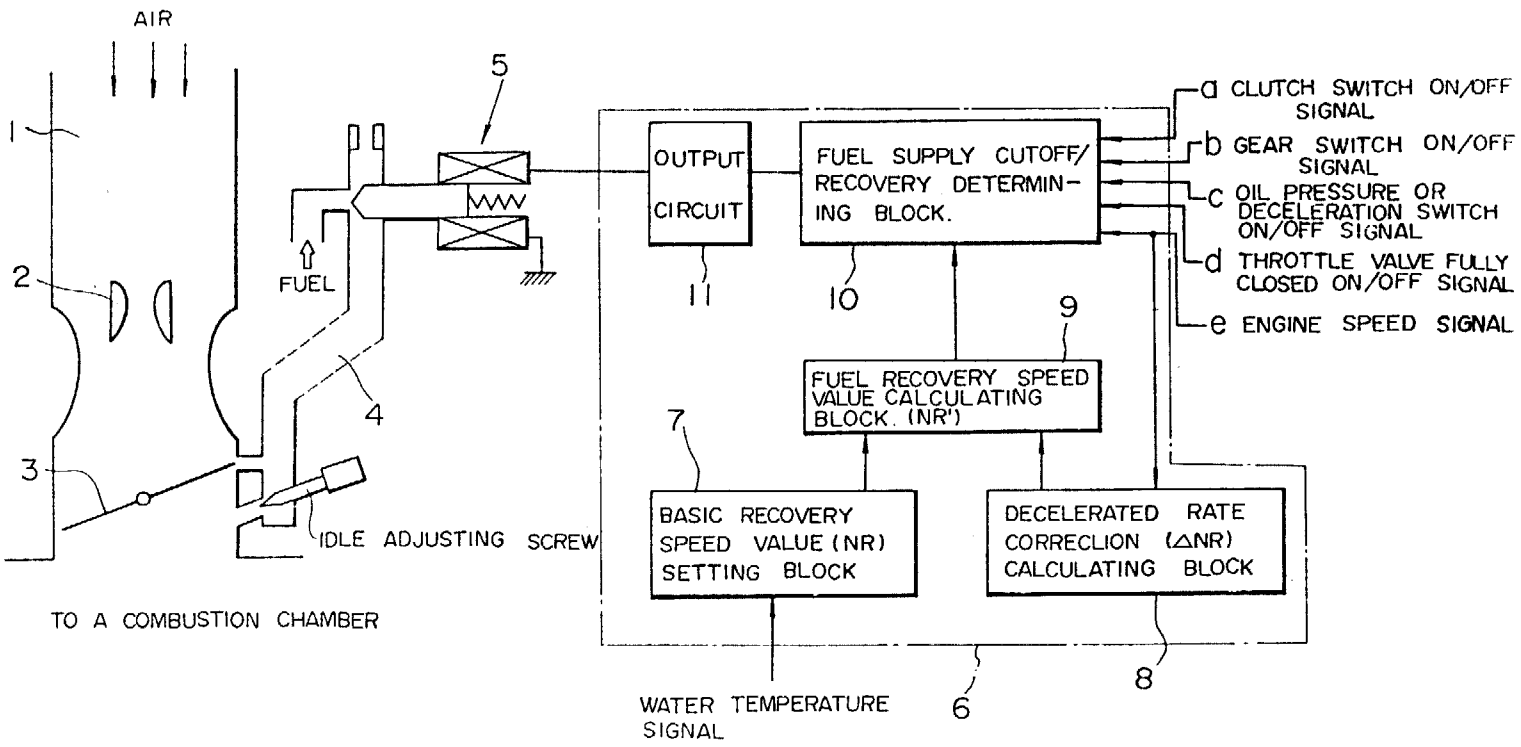
FIG. 1 is a schematic diagram of the fuel supply control system of a preferred embodiment used in a carburetor for supplying an air mixture fuel to an engine according to the present invention.

Reference is made to the drawings, firstly to FIG. 1, which is a schematic diagram of a fuel supply control system used in a carburetor of an internal combustion engine according to the present invention.

The control system of FIG. 1 includes an air intake passage, a venturi and a throttle valve. The venturi 2 is provided within the air intake passage for producing a partial vacuum proportional to the air flow rate causing a fuel nozzle to deliver a fine spray of fuel or gasoline substantially proportional to the air flow rate into the passing air stream. The throttle valve 3 can be tilted to open or close the air intake passage 1.

At the end of passage 1 near the venturi 2, a main fuel passage having a main fuel nozzle (not shown in this drawing) is opened to deliver a fine spray of fuel or gasoline in an amount substantially proportional to the amount of air flow per unit of time into the air intake passage 1 via the main fuel passage due to a vacuum developed by the venturi 2, depending on the degree of opening the throttle valve 3. Consequently, a substantially constant air to fuel ratio mixture is supplied to the combustion chamber.

However, when the throttle valve 3 is turned substantially to the horizontal position, that is, the throttle valve 3 is opened to a very small angle as shown in FIG. 1, the vacuum produced at the venturi becomes insufficient to deliver a required amount of fuel from the main fuel passage into the air intake passage 1.

To cope with such a situation, when the engine is decelerated at a so called low speed, a slow fuel passage is provided as another fuel passage at the end of intake air passage 1 near throttle valve 3. When the throttle valve 3 is opened to a very small angle, the required amount of fuel from the slow fuel passage 4 is delivered into the air intake passage 1 to secure a stable combustion. A slow cut solenoid valve 5 is located in the slow fuel passage 4 for cutting off the fuel supply by closing the slow fuel passage 4 when no output signal is fed thereto from a control unit 6 for energizing the valve 5 on condition that the engine is decelerated until a certain condition described below is satisified. At this time, since the throttle valve 3 is now fully closed or turned to the horizontal position, the fuel cannot be delivered through the main fuel passage and the slow fuel passage 4. Therefore, no fuel is supplied to the engine to prevent an unnecessary amount of fuel from being supplied to the engine.

The control unit 6 is a microcomputer system comprising a basic fuel recovery rotation speed limit calculating block 7, a decelerated rate correction calculating block 8, a fuel recovery speed limit calculating block 9, a fuel supply cutoff or recovery determining block 10, and an output circuit 11. As in the conventional system, the fuel supply is cut off in response to a predetermined condition, e.g., when the engine rotation speed N drops from a speed value above a first predetermined value NJC. Thereafter, the fuel supply through slow fuel passage 4 resumes when the engine rotation speed N drops through the fuel supply cutoff speed region described above to a second predetermined value (fuel recovery rotation) NR.

To these ends, the control unit 6 performs an arithmetic operation as shown by the flowcharts of FIG. 2 through FIG. 5.

Figure 2:
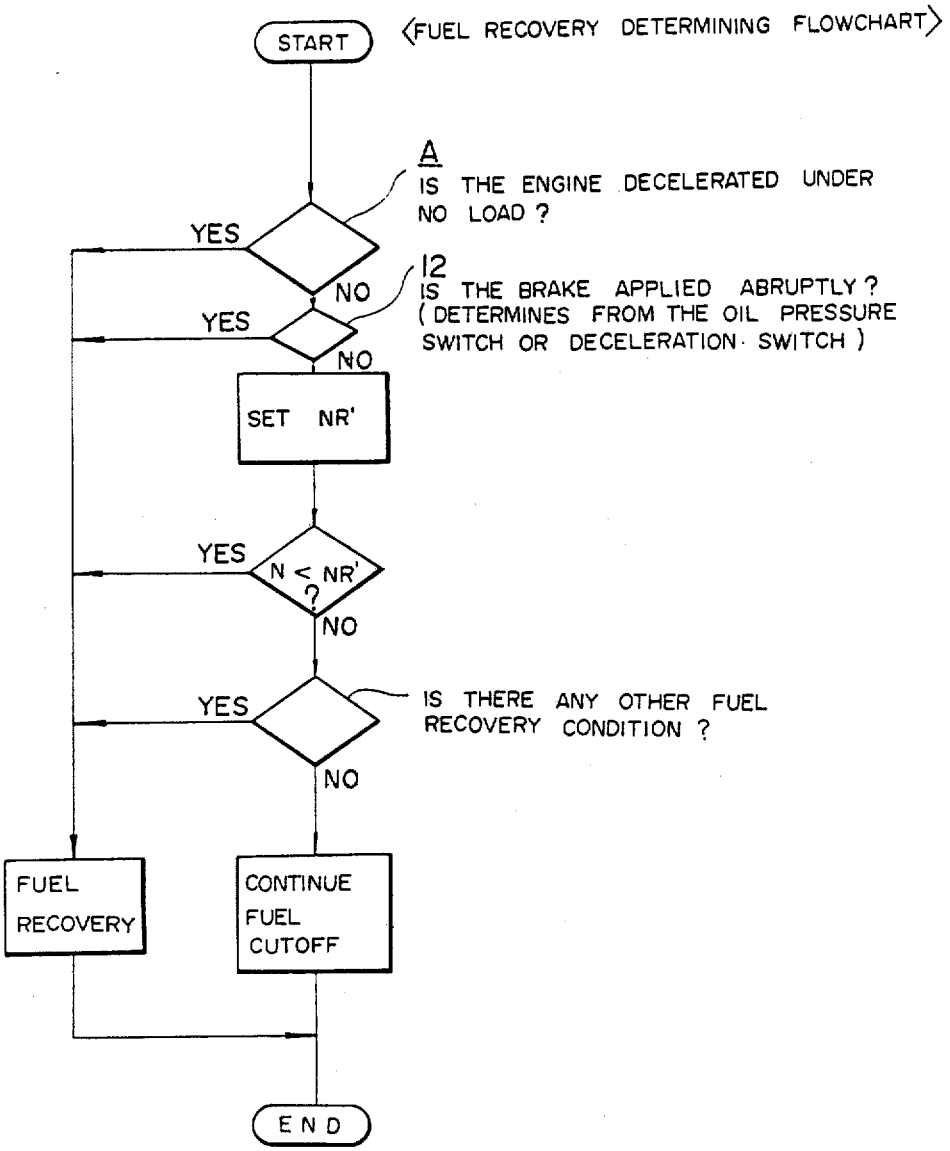
FIG. 2 is an overall fuel supply recovery determining flowchart for the operation of a control unit used in the preferred embodiment according to the present invention shown in FIG. 1.
Figure 3:
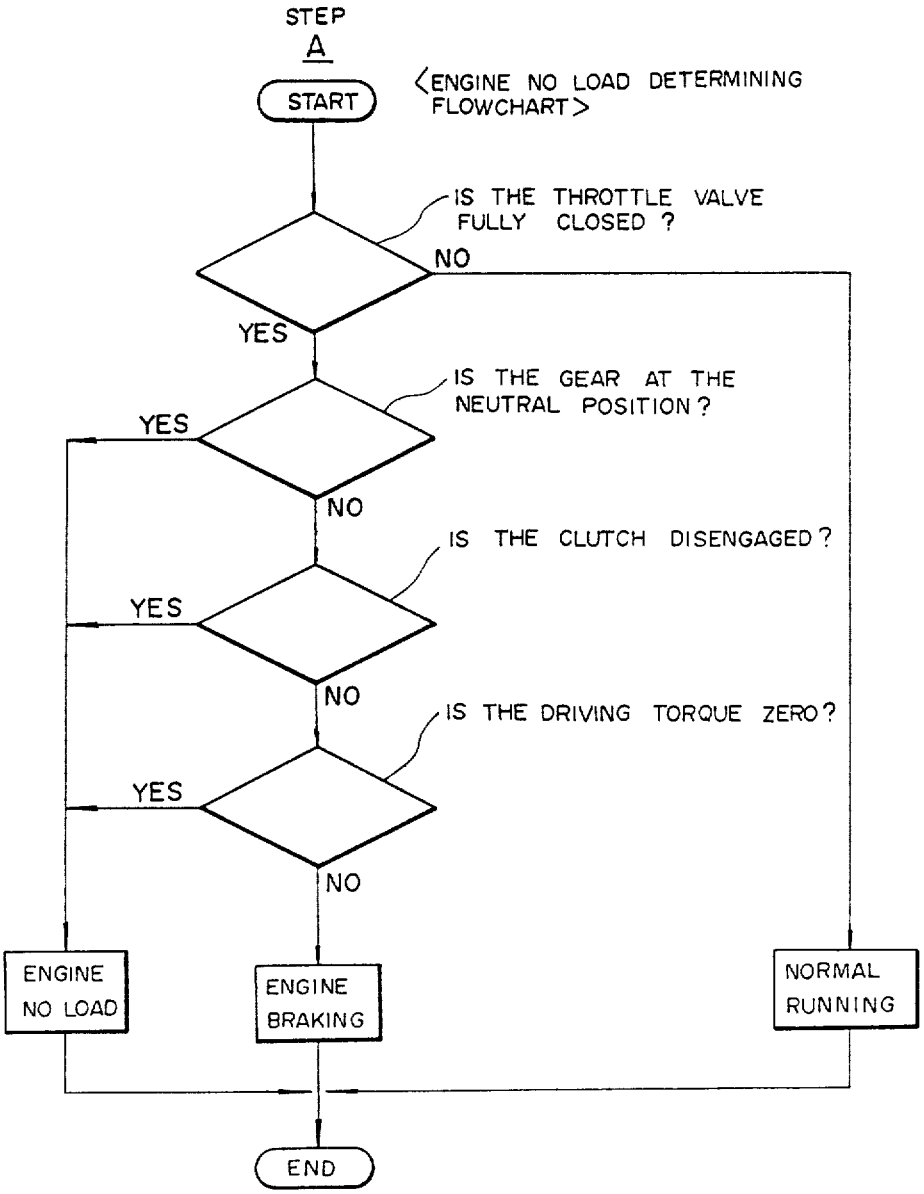
FIG. 3 is an engine no load determining flowchart in detail of a step A in FIG. 2 for the operation of a control unit used in the preferred embodiment shown in FIG. 1.

When the engine is decelerated below the first predetermined value NRJ and the fuel supply is cutoff, the control unit 6 checks to see whether the engine is being decelerated under unloaded condition at a step A as shown in FIG. 2. At a step A as shown in FIG. 3 the control unit 6 checks to see whether the throttle valve 3 is fully closed; if that is the case, unit 6 then checks to see whether the transmission gear lever is at the neutral position as shown in FIG. 3. If that is the case, the control unit 6 determines that the engine is idling and operates so no output signal is supplied to the slow cut solenoid valve 5 whereby no fuel is supplied through slow fuel passage 4 when the engine speed reaches the second predetermined value NR without first modifying the second predetermined value NR. If the transmission gear is found not to be at the neutral position, the control unit 6 checks to see whether the clutch is disengaged. If that is the case, the control unit 6 determines that the engine is idling and operates as described above. If the clutch is engaged, the control unit 6 checks to see whether the driving torque is zero. If that is so, the control unit 6 determines that the engine is idling and operates as described above. If the driving torque is not zero, the control unit 6 determines that the engine is being decelerated by the application of the engine brake and advances to the next step 12 in FIG. 2. It is to be noted that the engine operates normally if the control unit 6 determines that the throttle valve 3 is not fully closed.

Figure 4:
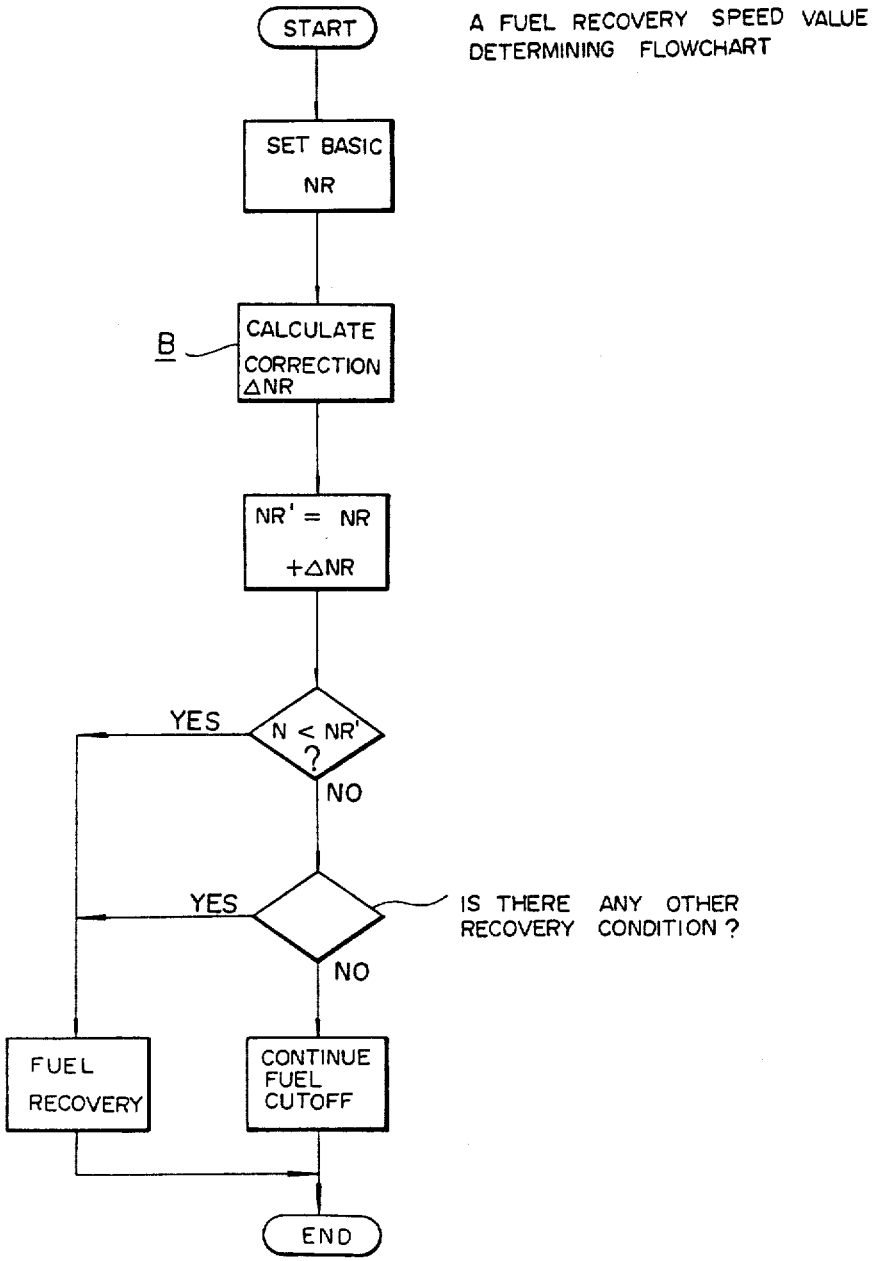
FIG. 4 is a second predetermined fuel recovery speed value determining flowchart showing in more detail processing steps following a step 12 in FIG. 2.

At step 12, the control unit 6 checks to see whether the engine speed drops to a second predetermined value NR by abrupt engine braking, as determined from the switching position of an oil pressure switch or deceleration switch provided within the vehicle. If so, the control unit 6 operates to open the slow cut fuel passage 4 to resume the fuel supply without modifying the second predetermined value NR. If not, the control unit 6 calculates the correction ΔNR depending on the rate of change of the engine rotational speed in unit of rpm, and then specifies a modified second predetermined value NR′ in place of the basic second predetermined value NR obtained on a basis of a cooling water temperature, as shown in FIG. 4. A calculating step B of the correction ΔNR is described hereinafter in more detail with reference to FIG. 5 and FIG. 6.

After specifying the modified second predetermined value NR′, the control unit 6 checks to see whether the engine is being decelerated through the value NR′. This modified second predetermined value NR′ is specified in a region where the engine does not stall. If the engine speed reaches the modified second value NR′, the control unit 6 operates to resume the fuel supply through slow fuel passage 4. If the engine speed does not fall below the value NR′, the control unit 6 searches for other fuel supply recovery conditions and, if none is found, continues the fuel supply cutoff, a shown in FIGS. 1 and 4.

Figure 5:
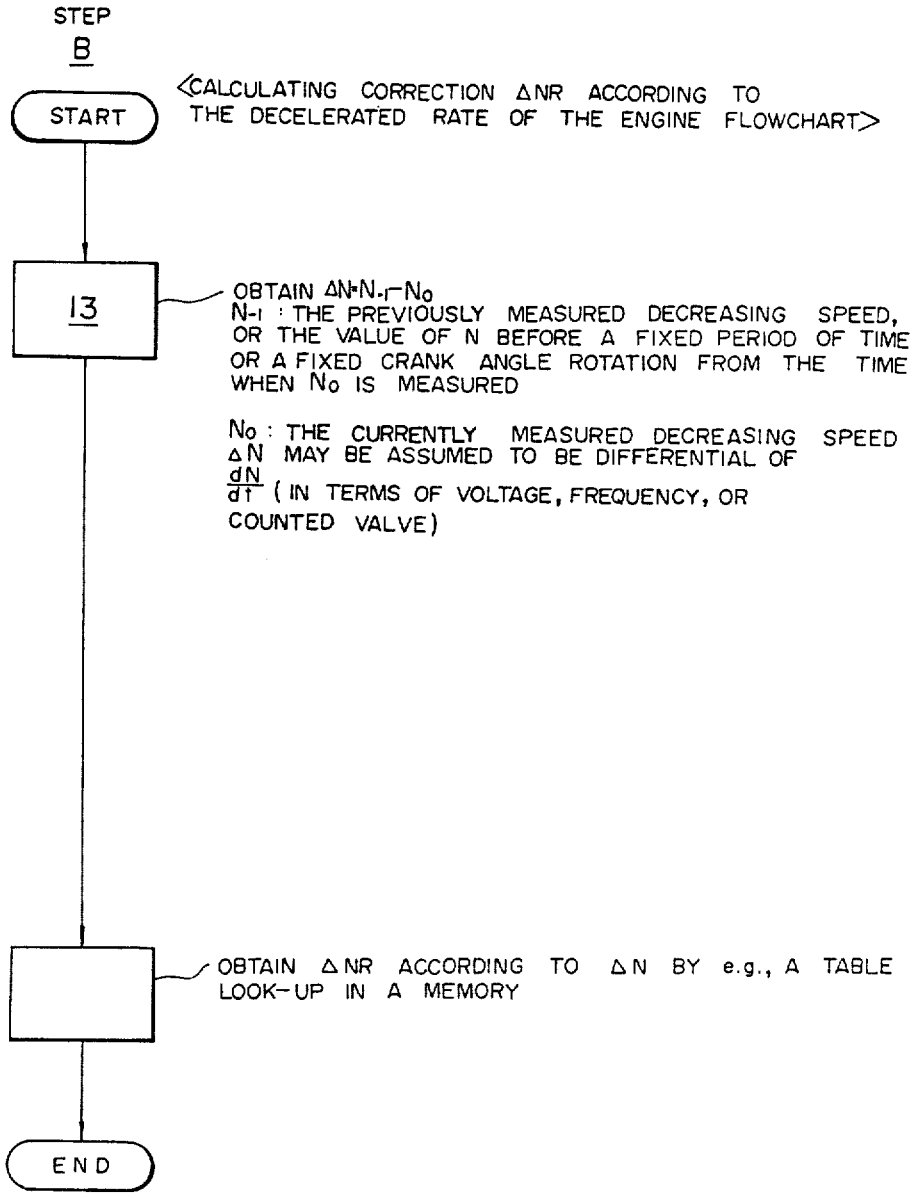
FIG. 5 is a calculating correction flowchart in detail of step B in FIG. 4.

The processing flow of the calculation of the correction NR at step B in FIG. 4 is described hereinafter with reference to FIG. 5.

Figure 6:
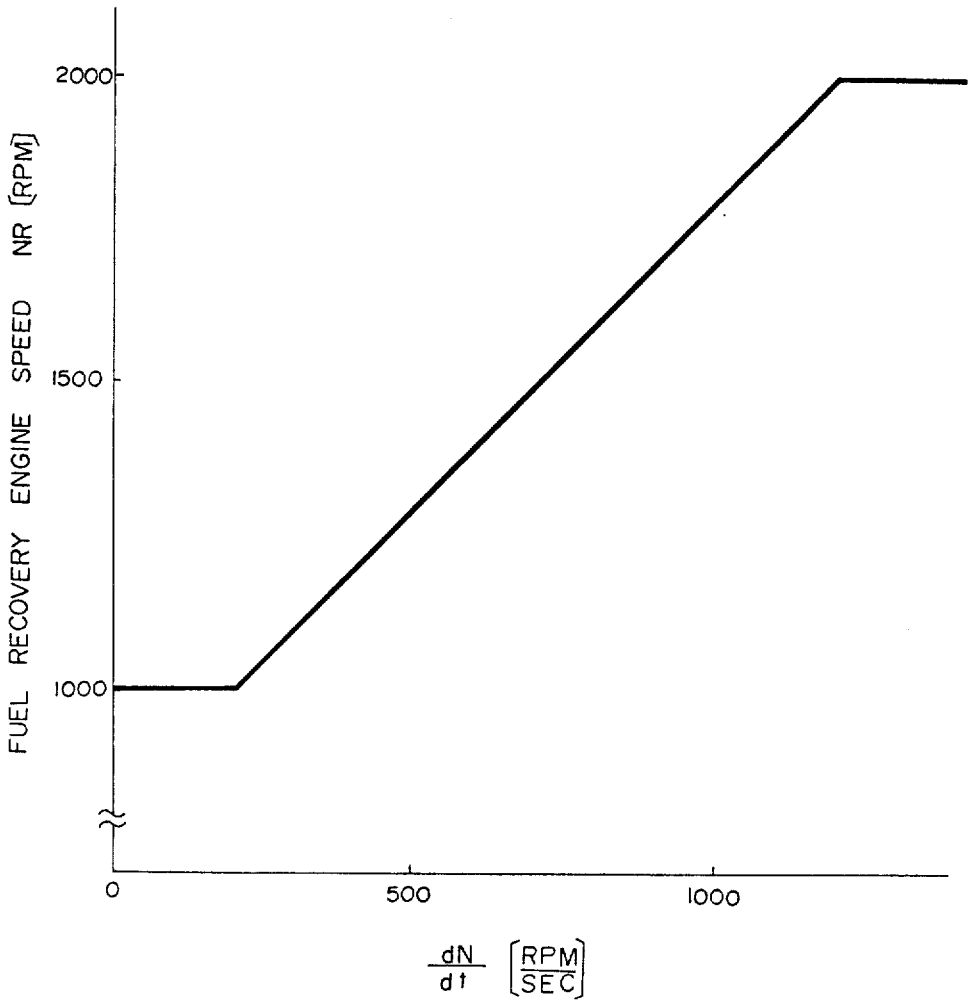
FIG. 6 is an explanatory graph of the relation between the differential of engine speed with respect to time and the recovery rotation value calculated by the control unit shown in FIG. 1.

First at step 13 the control unit 6 calculates from an engine speed signal the difference ΔN between the previously detected speed $N_{-1}$ and the currently detected speed N expressed in an equation as $\Delta N = N_{-1} - N$. In this case, the previously detected speed $N_{-1}$ is a value of the engine speed before a fixed period of time or before a fixed crank angle (a fixed rotation). As another example, a differential signal of dN/dt (in terms of voltage, frequency, or counted value) is assumed to be ΔN. Next, at step 14 the quantity of correction ΔNR according to ΔN is calculated or obtained by a look-up table in a memory. After determining ΔNR, the second predetermined speed value NR is lowered accordingly, as shown in FIG. 6.

As described hereinbefore, according to the present invention there is provided a fuel supply cutoff system for an internal combustion engine whereby a predetermined engine rotation speed limit which triggers the resumption of the fuel supply into the combustion chamber is lowered to some degree from the basic value when the engine rotation speed is gradually reduced, as for example, during slow engine braking, compared to the case of a sudden reduction of the engine rotation speed, e.g., when the accelerator pedal is released while the transmission gear lever is at neutral or the engine is idling, or in the case of sudden brake pedal depression. The engine speed limit is not lowered to such an extent that the engine stalls.

Consequently, a region within which the fuel supply cutoff is executed is extended downwards so that considerable savings of fuel can be effected.

It will be understood by those skilled in the art that the above and other similar modifications may be made in the preferred embodiment described above without departing from the spirit and scope of the present invention, which is to be defined by the following claims.

What is claimed is:

1. A fuel supply control system for an internal combustion engine for driving an automotive vehicle, a fuel supply to the engine being cut off when the engine speed decreases from above a first predetermined value NRJ, the fuel supply being resumed when the engine speed, after being decreased from the first predetermined value NRJ is less than a second predetermined value NR, the fuel supply system comprising:

(a) first detecting means for signalling that the engine is decelerated and is under noload condition;

(b) second detecting means, responsive to the first detecting means signalling that the engine is not decelerated and is under noload condition, for signalling that a brake pedal of the vehicle is abruptly actuated; and (c) means for calculating the second predetermined speed value NR and correcting the calculated second predetermined speed value so as to lower the second predetermined speed value NR when said second detecting means signals that the brake pedal is not actuated abruptly as compared with the speed value calculated either in the case when said second detecting means signals that the brake pedal is actuated abruptly or in the case when said first detecting means signals that the engine is decelerated under no-load condition within a region where engine stalling does not occur.

2. The fuel supply control system of claim 1, wherein the fuel supply control system further comprises an output circuit for outputting a signal to a slow fuel supply passage of the engine for opening the slow fuel supply passage according to the determination of the actual second predetermined speed value by said calculating and correcting means.

3. The fuel supply control system of claim 1, wherein the calculating and correcting means also corrects the calculated second predetermined speed value NR so as to lower continuously the second predetermined speed value NR according to a decreasing rate of engine speed in both cases when said first detecting means signals that the engine is abruptly decelerated under no-load condition and when said detecting means signals that the brake pedal is actuated abruptly within a range where the engine stalling does not occur.

4. The fuel supply control system of claim 1 or 3, wherein said calculating and correcting means comprises:

(a) a first block for determining a basic second predetermined speed value NR on the basis of an indication of the engine cooling water temperature;

(b) a second block for determining a deviation correction amount ΔNR on a basis of decreasing rate of engine speed for the basic second predetermined speed value NR; and (c) a third block for determining the actual second predetermined speed value NR′ by summing the basic second predetermined speed value NR obtained from said first block with the deviation correction amount ΔNR obtain from said second block.

5. The fuel supply control system of claim 4 wherein said second block determines the deviation correction amount ΔNR according to the difference, ΔN, between the values of the engine speeds before and after a predetermined period of time.

6. The fuel supply control system of claim 4 wherein said second block determines the deviation correction amount ΔNR according to the difference, ΔN, between the values of the engine speeds before and after a predetermined engine revolution.

7. The fuel supply control system of claim 4 wherein said second block determines the deviative correction amount ΔNR according to a differentiation result dN/dt of the present engine speed decreasing with respect to time.

8. The fuel supply control ystem of claim 1 wherein said first detecting means signals that the engine is decelerated under no-load condition while the throttle valve is in a closed position on a basis of any of: an indication of zero engine driving torque, transmission gear being in neutral position, and the clutch being disengaged.

9. The fuel supply control system of claim 1 wherein said second detecting means signals that the brake pedal is abruptly actuated in response to a signal from an oil pressure switch.

10. The fuel supply control system of claim 1 wherein said second detecting means signals that the brake pedal is abruptly actuated in response to a signal from a deceleration switch.

11. A fuel supply control system for an internal combustion engine of an automotive vehicle, comprising:

(a) first means for halting the fuel supply to the engine during the deceleration thereof from an engine speed which is above a first predetermined value;

(b) second means for resuming the fuel supply to the engine when the engine speed decreases to a second predetermined value which is smaller than said first predetermined value;

(c) third means for determining a value for the rate of change of engine speed; and (d) fourth means for correcting said second predetermined value based on the value determined by said third means such that said second predetermined value is lowered as the determined rate of change of engine speed becomes smaller.

12. The fuel supply control system of claim 11 wherein said third means determines the rate of change of engine speed according to the difference between the previous engine speed value before a predetermined period of time and the current engine speed after the predetermined period of time has passed.

13. The fuel supply control system of claim 11 wherein said third means determines the rate of change of engine speed according to the difference between the previous engine speed value and the present engine speed after the engine revolves through a predetermined revolution.

14. The fuel supply control system of claim 11 wherein said third means determines the rate of change of engine speed according to a differentiation result of the present engine speed with respect to time.

15. The fuel supply control system of claim 11 wherein said fourth means determines a correction value for the second predetermined value according to the rate of change of engine speed determined by said third means and sums the correction value with the second predetermined value.

16. Apparatus for reducing fuel consumption of a decelerating internal combustion engine of an automotive vehicle and for preventing stalling of the engine, comprising means responsive to engine and brake responsive parameters of the vehicle for: (a) deriving a first signal indicating that the engine is decelerating and the brake is being applied abruptly and the engine is not under load while the engine speed is less than a first predetermined value and fuel supplied to the engine is cut-off; (b) deriving a second signal indicating that engine speed is less than a second value, the second value being less than the first speed value and responsive to the rate of change of engine speed, the second signal being derived in response to the first signal not being derived while the engine speed is less than a first predetermined value and fuel supplied to the engine is cut-off, and means for resuming the supply of fuel to the engine in response to derivation of any of the first and second signals.

17. Apparatus for reducing fuel consumption of a decelerating internal combustion engine of an automotive vehicle and for preventing stalling of the engine, the vehicle including main and slow fuel passages and a throttle valve for selectively supplying air and fuel from the passages of the engine, the slow fuel passage including a slow cut valve for normally preventing the flow of fuel through the slow fuel passage and, comprising means for sensing the throttle valve being in a fully closed condition and for deriving a first signal indicative thereof, means for sensing engine speed dropping below a first predetermined value and for deriving a second signal indicative thereof, means responsive to the derivation of the first and second signals for activating a controller for the slow cut valve, said controller including means responsive to engine and brake responsive parameters of the vehicle for opening the slow cut valve in response to any of: (a) the engine being decelerated under no load, and; (b) the brake being abruptly applied, and; (c) the engine speed dropping below a second value, the second value being less than the first value and being determined in response to the rate of change of engine speed.

18. The apparatus of claim 17 wherein the means for opening the slow cut valve includes means for determining that the engine is being decelerated under no load in response to any of: a transmission for the vehicle being in neutral position, and a clutch for the vehicle being disengaged, and driving torque of the motor being zero.

19. Apparatus for reducing fuel consumption of a decelerating internal combustion engine of an automotive vehicle and for preventing stalling of the engine, the vehicle including valve means for selectively supplying air and fuel to the engine, comprising means for sensing the valve means being in a fully closed condition and for deriving a first signal indicative thereof, means for sensing engine speed dropping below a first predetermined value and for deriving a second signal indicative thereof, means responsive to the derivation of the first and second signals for activating a controller for the valve means, said controller including means responsive to engine and brake responsive parameters of the vehicle for opening the valve means in response to any of: (a) the engine being decelerated under no load, and; (b) the brake being abruptly applied, and; (c) the engine speed dropping below a second value, the second value being less than the first value and being determined in response to the rate of change of engine speed.

20. The apparatus of claim 19 wherein the means for opening the valve includes means for determining that the engine is being decelerated under no load in response to any of: a transmission for the vehicle being in neutral position, and a clutch for the vehicle being disengaged, and driving torque of the motor being zero.

21. Apparatus for reducing fuel consumption of a decelerating internal combustion engine of an automotive vehicle and for preventing stalling of the engine, the vehicle including valve means for selectively supplying air and fuel to the engine, comprising means for sensing the valve means being in a fully closed condition and for deriving a first signal indicative thereof, means for sensing engine speed dropping below a first predetermined value and for deriving a second signal indicative thereof, means responsive to the derivation of the first and second signals for activating a controller for the valve means, said controller including means for opening the valve means in response to the engine speed dropping below a second value, the second value being less than the first value and being determined in response to the rate of change of engine speed.

22. The apparatus of claim 16, 17, 19 or 21 wherein the second value decreases as the rate of change of engine speed decreases.

23. The apparatus of claim 16, 17, 19 or 21 wherein the second value of engine speed decreases as the rate of change of engine speed decreases between the first and second values thereof, the second value of engine speed being set at third and fourth values in response to the rate of change of engine speeds being greater and less than the first and second values thereof.

24. Apparatus for reducing fuel consumption of a decelerating internal combustion engine of an automotive vehicle and for preventing stalling of the engine, the vehicle including valve means for selectively supplying air and fuel to the engine, comprising means for sensing the valve means being in a fully closed condition and for deriving a first signal indicative thereof, means for sensing engine speed dropping below a first predetermined value and for deriving a second signal indicative thereof, means responsive to the derivation of the first and second signals for activating a controller for the valve means, said controller including means for opening the valve means in response to the brake being abruptly applied.

25. The apparatus of claim 24 further including an oil pressure switch for sensing the abrupt application of the brake.

26. The apparatus of claim 24 further including a deceleration switch for sensing the abrupt application of the brake.

* * * * *